US006131896A

United States Patent [19]

Csipkes et al.

[11] Patent Number: 6,131,896

[45] Date of Patent: Oct. 17, 2000

[54] OPTICAL ASSEMBLY WORKSTATION HAVING AN ELEVATED WORK SURFACE MOVABLE RELATIVE TO A PRINCIPAL WORK SURFACE

[75] Inventors: Andrei Csipkes, Savage; William Keith Chandler, Woodsboro; Michael E. Schollian, Glen Burnie, all of Md.

[73] Assignee: CIENA Corporation, Linthicum, Md.

[21] Appl. No.: 09/021,835

[22] Filed: Feb. 11, 1998

[51] Int. Cl.[7] ..... B25B 1/22

[52] U.S. Cl. ..... 269/73; 269/903; 269/100

[58] Field of Search ..... 269/73, 45, 71, 269/99, 903, 100

[56] References Cited

U.S. PATENT DOCUMENTS

| | | | |
|---|---|---|---|
| 372,714 | 11/1887 | Shaw | 269/73 |
| 2,887,079 | 5/1959 | Wilson | 269/45 |
| 4,434,693 | 3/1984 | Hosoi et al. | 269/73 |
| 4,528,747 | 7/1985 | Hoffman et al. | 269/903 |
| 4,766,465 | 8/1988 | Takahashi | 269/73 |
| 5,716,043 | 2/1998 | Iwata et al. | 269/73 |

*Primary Examiner*—David A. Scherbel
*Assistant Examiner*—Lee Wilson
*Attorney, Agent, or Firm*—Daniel N. Daisak; David L. Soltz

[57] ABSTRACT

An optical assembly workstation includes a principal work surface and a movable work surface arranged above the principal work surface, with the elevated work surface being movable back and forth in at least one axial direction relative to the principal work surface. A frame assembly provides both support and a mechanism for moving the elevated work surface relative to the principal work surface. The movable work surface is either configured to receive an optical work piece, or is itself the optical work piece. The arrangement of a movable work surface over the principal work surface provides flexibility in optical test and optical assembly equipment placement, frees the principal work surface area of clutter, and reduces the probability of inadvertent damage to the optical fibers and optical assemblies being manufactured or tested at the optical assembly workstation.

12 Claims, 3 Drawing Sheets

OPTICAL ASSEMBLY WORKSTATION HAVING AN ELEVATED WORK SURFACE MOVABLE RELATIVE TO A PRINCIPAL WORK SURFACE

BACKGROUND OF THE INVENTION

1. Field of the Invention

The present invention generally relates to an optical fiber and optical assembly workstation, and more particularly, to an optical fiber/optical assembly workstation that includes a fixed principal work surface and a movable work surface arranged above the principal work surface, where this elevated movable work surface can be configured to carry an optical work piece, or where the elevated movable work surface is itself the optical work piece.

2. Description of the Related Art

Flaws in an optical fiber that are introduced during fabrication, handling, placement, or even exposure to the atmosphere, all represent points of potential fiber failure. A fiber once flawed may be further degraded by stress corrosion, causing the defect to expand or grow. Moisture, mechanical stress, and chemical attack can all accelerate stress corrosion in an optical fiber.

Accordingly, in the design and manufacture of optical fibers and their associated network connections, amplifiers, and multiplexers, a major objective is the elimination of as many stresses as possible. For example, stress phenomena such as microbending and macrobending can cause significant attenuation to light transmission through the fiber. Microbending may be defined as small abrupt changes in the optical fiber core mechanical structure, or sharp irregularities at the interface between the fiber cladding and the core materials. Although extremely small, such irregularities introduced in the manufacturing process produce significant additional light attenuation. Macrobending occurs when a fiber bend radius decreases to the point that light rays within the core start to escape into the cladding material. The radius at which macrobending occurs depends upon the fiber size, type, and the operating light wavelength.

Generally, the manufacture of optical fibers and associated connectors, amplifiers and the like is carried out by an operator at an optical fiber or optical assembly workstation (hereinafter "optical assembly workstation"). The conventional optical assembly workstation consists of a flat work surface, on which optical work pieces are arranged. Optical work pieces may comprise any number of apparatus that are used in manufacturing optical devices, including optical fiber cassettes, manufacturing or optical assembly trays, and optical test equipment.

However, due to the many processing steps and/or testing steps that must be performed to ensure high quality optical fibers, a number of pieces of test equipment and assembly equipment, in addition to the fiber cassettes, must be accommodated at the workstation. Therefore, the work surface becomes crowded, especially the portion of the work surface within an arm's length reach of the operator. As a result, there is a high probability that the operator will inadvertently lean on the optical fibers while reaching for a piece of equipment, or inadvertently place a piece of assembly or test equipment on the optical fibers, perhaps causing microbends as described earlier, or even breakage. Also, the repeated maneuvering of the fiber cassettes in the confined and crowded area between the assembly trays and test equipment on the workstation could also inadvertently damage the optical fibers by over-bending or over-stressing the optical fibers.

The crowded workstation area and lack of flexibility in placement of the assembly and test equipment leads to decreased production capacity due to optical fiber breakage, or the necessity for rework of lower quality optical fibers and optical fibers assemblies.

Accordingly, there exists a need for an optical assembly workstation that can provide flexibility in equipment placement, free the work area of clutter, and reduce the probability of inadvertent damage to the optical fibers and optical assemblies being manufactured at the workstation.

SUMMARY OF THE INVENTION

The present invention is therefore directed to an optical assembly workstation that substantially overcomes one or more of the problems due to the limitations and disadvantages of the conventional art.

In general, the present invention provides an optical assembly workstation which includes a principal work surface and a movable work surface arranged above the principal work surface. The elevated work surface is movable in at least one axial direction, but is preferably movable in two axial directions, relative to the principal work surface. A frame assembly provides both support for the elevated work surface and a mechanism for moving the elevated work surface relative to the principal work surface. The movable work surface may itself be an optical work piece, such as an optical fiber cassette, manufacturing or optical assembly tray, or optical test equipment. In addition, the movable work surface can be configured to support a separate optical work piece above the principal work surface.

In another aspect, the frame assembly is also movable in at least one, but preferably two axial directions relative to the principal work surface. In this embodiment, a mechanism is provided below the principal work surface to move the entire frame assembly in broad lateral and/or longitudinal directions. Then, above the principal work surface, lateral and/or longitudinal shelf rails provide for the fine adjustment of the movable work surface relative to the principal work surface. This particular embodiment allows the elevated work surface to be movable over a larger area of the principal work surface thereby providing added flexibility, but with slightly more complexity in the frame assembly structure and a slightly reduced usable principal work surface area.

The arrangement of a movable work surface over the principal work surface provides flexibility in equipment placement, frees the principal area of clutter, and reduces the probability of inadvertent damage to the optical fibers and optical assemblies being manufactured or tested at the optical assembly workstation.

BRIEF DESCRIPTION OF THE DRAWINGS

The foregoing and other objects, aspects and advantages will be described with reference to the drawings, in which.

DETAILED DESCRIPTION OF THE PREFERRED EMBODIMENTS

While the present invention is described herein with reference to illustrative embodiments for particular applications, it should be understood that the present invention is not limited thereto. Those having ordinary skill in the art and access to the teachings provided herein will recognize additional modifications, applications, and embodiments within the scope thereof and additional fields in which the invention would be of significant utility without undue experimentation.

Figure 1:
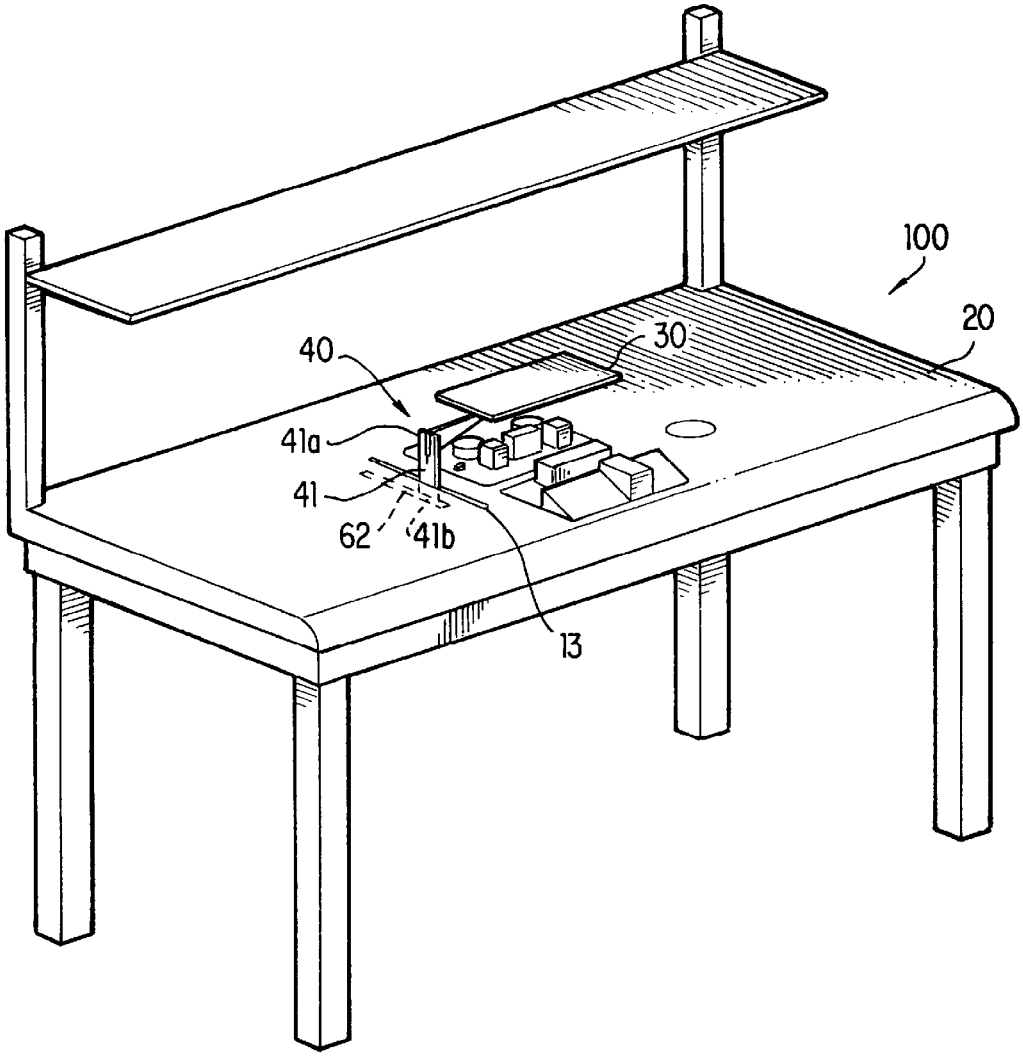
FIG. 1 is a perspective view of an optical assembly workstation in accordance with the present invention.
Figure 2:
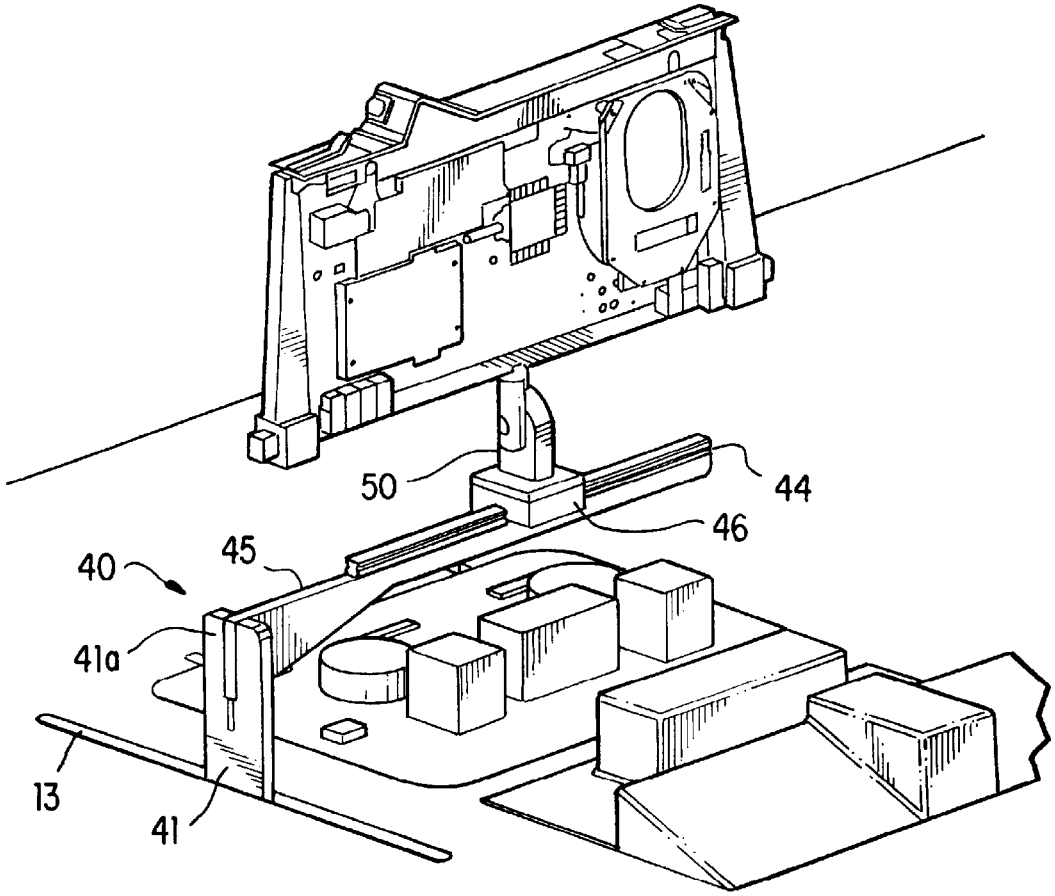
FIG. 2 is an enlarged perspective view of an optical assembly workstation in accordance with the present invention.

FIG. 1 is a perspective view of the optical assembly workstation 100 of the present invention. FIG. 2 provides a more detailed perspective view of the shelf rail assembly that is attached to the frame assembly of FIG. 1. For simplicity and ease of discussion, in the following description of the invention, the terms "lateral" and "longitudinal" are used to refer to movement back and forth along a first axis and movement back and forth along a second axis perpendicular to the first axis, respectively. The first and second axes are defined relative to movement over the principal work surface of the workstation.

Referring generally to FIG. 1 and FIG. 2, the optical assembly workstation 100 includes a principal work surface 20 and a movable work surface 30. A frame assembly 40 serves the dual functions of orienting the movable work surface 30 above the principal work surface 20, as well as providing a mechanism to move the work surface 30 relative to the principal work surface 20. One of ordinary skill in the art would understand that, within the scope of the present invention, the frame assembly 40 can either be connected to a portion of the principal work surface 20, connected to a structure separate from the optical assembly workstation 100, or extend through an opening in the workstation 100 as shown in FIG. 1. In each case, the frame assembly 40 would function to elevate the movable work surface 30 above the principal work surface 20, as well as provide a mechanism to move the work surface 30 relative to the principal work surface 20.

Preferably, the frame assembly 40 is oriented as shown in FIG. 1, namely, the frame assembly 40 is located close to the optical work area so as to eliminate the need for extended cantilever support structures extending from the periphery of the principal work surface 20. This reduces obstructions in the work area and also allows a smaller and more stable frame assembly to be employed in the optical assembly workstation.

The portion of the frame assembly 40 above the principal work surface 20 will be described first. In the embodiment shown in FIG. 1, the principal work surface 20 contains an opening 13 through which a vertical support member 41 of the frame assembly 40 extends. The opening 13 need only be of sufficient size to allow an upper end 41*a* of the vertical support member 41 to extend through the opening 13. The upper end 41*a* of the vertical support member 41 is connected to one end of a lateral shelf rail 44 as best shown in FIG. 2. Optionally, the upper end 41*a* of the vertical support member 41 can be connected to a cantilevered lateral support member 45, with the lateral shelf rail 44 then being attached to the lateral support member 45.

A lateral shelf bearing 46 is slidably attached to the lateral shelf rail 44, and thus moves back and forth in a lateral direction above the principal work surface 20. In the embodiment shown in FIG. 1, the bottom of the work surface 30 would then be attached to the lateral shelf bearing 46, to enable lateral movement of the work surface 30 relative to the principal work surface 20. The lateral shelf bearing 46 may be formed as an integral part of the work surface 30, or in another embodiment, the lateral shelf bearing 46 and work surface 30 can be separately formed and thereafter attached to each other as described above.

Figure 4:
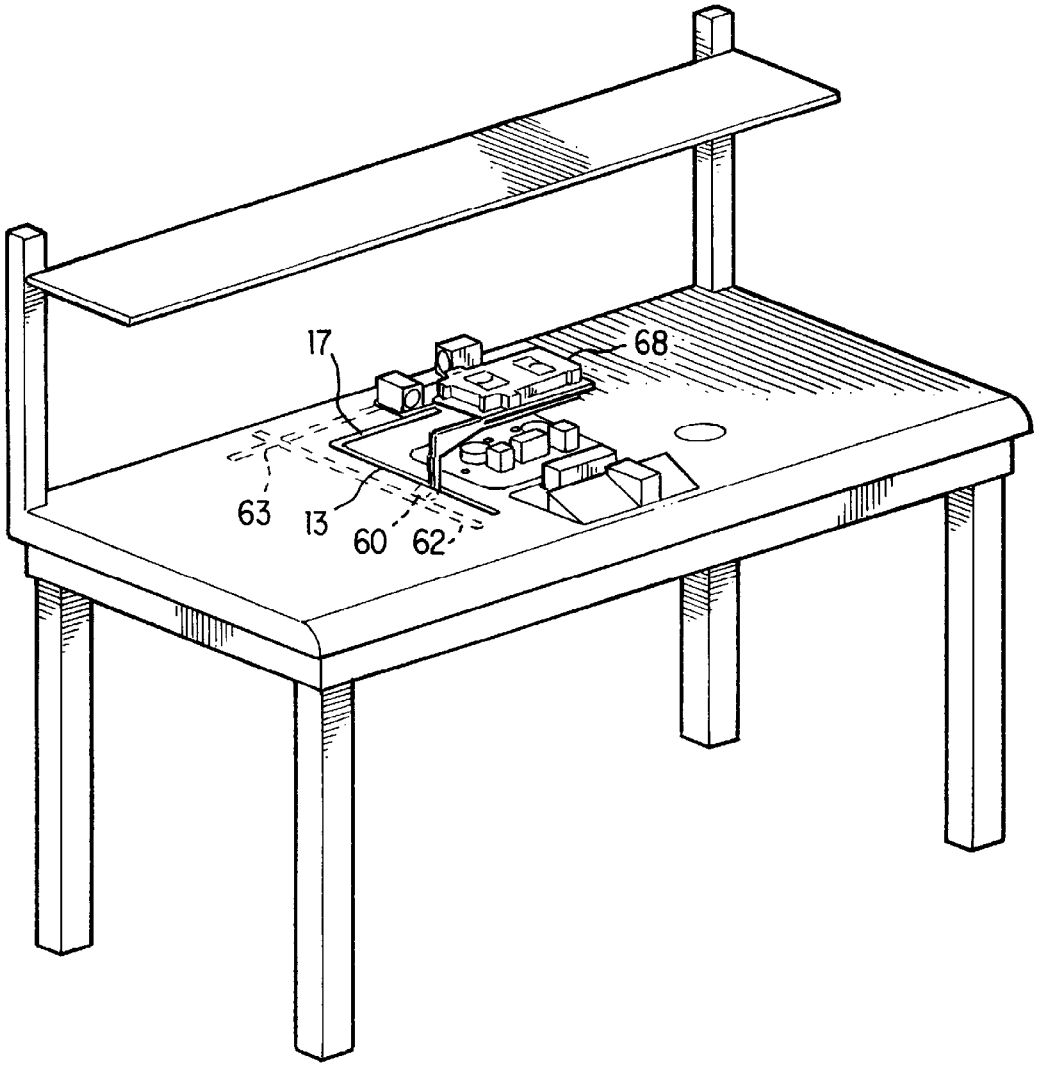
FIG. 4 is a perspective view of another embodiment of an optical assembly workstation in accordance with the present invention.

As shown in FIG. 1, the work surface 30 is comprised of a flat surface which is capable of supporting an optical work piece. Preferably, the work surface 30 is itself the optical work piece. As described previously, the optical work piece may be a fiber cassette, an assembly tray, or optical test equipment. For example, reference numeral 52 in FIG. 2 depicts an optical work piece for splicing an optical fiber to an electronic board, and reference numeral 68 in FIG. 4 depicts an add/drop module tray, each of which is directly connected to the lateral shelf rail 44. Moreover, as shown in FIG. 2, a vise 50 can be mounted to the lateral shelf bearing 46 to grip the optical work piece 52. The vice 50 not only grips the work piece, it allows the work piece to be titled for ease of splicing.

While the provision of the lateral shelf rail 44 allows back and forth movement of the elevated work surface 30 along one axial direction (i.e., lateral) relative to the principal work surface 20, it is preferable to provide a mechanism for allowing back and forth movement of the work surface 30 along two axial directions, namely, laterally and longitudinally relative to the principal work surface 20.

Figure 3:
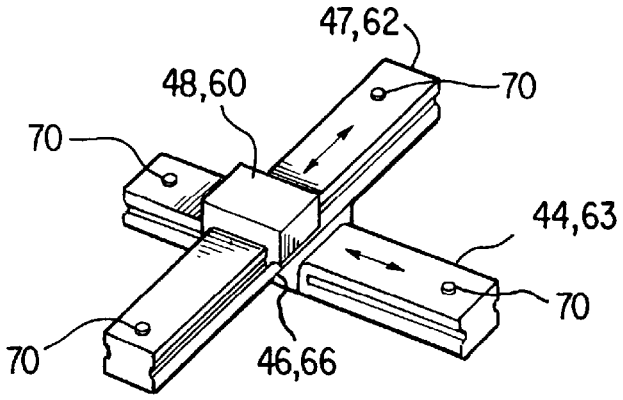
FIG. 3 is a perspective view of a portion of a sliding rail assembly used in the optical assembly workstation in accordance with the present invention.

FIG. 3 illustrates a rail assembly capable of moving an object along two separate axes. In the two-axis embodiment, rather than attaching the work surface 30 to the lateral shelf bearing 46, a longitudinal shelf rail 47 would be connected to the lateral shelf rail 44 via the lateral shelf bearing 46, with the longitudinal shelf rail 47 being perpendicular to the lateral shelf rail 44. A longitudinal shelf bearing 48 is then slidably attached to the longitudinal shelf rail 47, and thus moves back and forth in a longitudinal direction above the principal work surface 20. The lower surface of the work surface 30 would then be attached to the longitudinal shelf bearing 48, to enable longitudinal movement of the work surface 30 relative to the principal work surface 20. The longitudinal shelf bearing 48 may be formed as an integral part of the work surface 30, or in another embodiment, the longitudinal shelf bearing 48 and the work surface 30 can be separately formed and thereafter attached to each other as described above. If the vise 50 of FIG. 2 is used, it would be attached to the longitudinal shelf bearing 48.

For stability and safety, stoppers 70 may be placed along the lateral shelf rail 44 and longitudinal shelf rail 47 to limit the degree of movement of the work surface 30 along the respective rails. The particular lengths of the respective rails would be selected based on the desired area of movement of the work surface 30 relative to the principal work surface 20.

Now, the portion of the frame assembly 40 below the principal work surface 20 will be described. If movement of the entire frame assembly 40 was not desired, the lower end 41*b* of the vertical support member 41 could merely be connected to an underside of the principal work surface 20 or some other fixed location. However, as shown in the embodiments of FIG. 1 and FIG. 4, if movement of the frame assembly 40 were desired, the rail assembly as shown in FIG. 3 may be adapted for use below the principal work surface 20 as well. Specifically, the lower end 41*b* of the vertical support member 41 would be connected via a frame bearing 60 to a lateral frame rail 62 (see FIGS. 1, 3 and 4), such that the vertical support member 41 would move back and forth in a lateral direction along the lateral frame rail 62 within the opening 13.

If desired, an additional longitudinal frame rail 63 can be connected to the lateral frame rail 62 with another frame bearing 66 as shown in FIG. 3 and FIG. 4. Accordingly, the vertical support member 41 could move back and forth in a longitudinal direction as well. As shown in FIG. 4, if the longitudinal frame rail 63 is employed, an elongated longitudinal opening 17 would be provided to allow longitudinal movement of the entire frame assembly 40 relative to the principal work surface 20.

While the elongated openings 13 and 17 allow greater lateral and longitudinal movement of the frame assembly 40, a portion of the principal work surface 20 is rendered unusable for the placement of assembly or test equipment thereon. Therefore, the particular lengths of the openings 13 and 17 should be selected based on a balancing of the desired area of movement of the work surface 30 relative to the principal work surface 20 and the area of the principal work surface 20 that must be utilized for assembly or test equipment.

As described above, the optical assembly workstation 100 of the present invention utilizes a frame assembly having a mechanism below the principal work surface 20 for moving the entire frame assembly 40 relative to the principal work surface, and a mechanism above the principal work surface 20 for moving the work surface 30 relative to the principal work surface 20. The present invention thus allows for board lateral and longitudinal movement of the work surface 30 relative to the principal work surface 20 using the lateral and longitudinal frame rails 62, 63. In addition, the present invention allows for fine lateral and longitudinal movement of the work surface 30 relative to the principal work surface 20 using the lateral and longitudinal shelf rails 44, 47.

The optical assembly workstation of the present invention has several advantages. The arrangement of a movable work surface over the principal work surface provides flexibility in equipment placement, frees the principal area of clutter, and reduces the probability of inadvertent damage to the optical fibers and optical assemblies being manufactured or tested at the optical assembly workstation. Note that in actual use, the optical assembly workstation of the present invention reduced defects by at least 50% over a six month period.

Although preferred embodiments of the present invention have been described in detail herein above, it should be clearly understood that many variations and/or modifications of the basic inventive concepts herein taught, which may appear to those skilled in the art, will still fall within the spirit and scope of the present invention as defined in the appended claims and their equivalents.

Having thus described our invention, what we claim as new and desire to secure by Letters Patent is as follows:

1. An optical assembly workstation comprising:

a principal work surface;

a movable work surface comprsing an optical work piece arranged above said principal work surface and movable along at least one axial direction relative to said principal work surface; and a frame assembly supporting said movable work surface above said principal work surface and providing a mechanism for moving said work surface relative to said principal work surface, said principal work surface containing an opening through which said frame assembly upwardly extends, said frame assembly further comprising:

a vertical support member extending upwardly through said opening in said principal work surface, a lateral shelf rail connected at one end to an upper end of said vertical support member; and a lateral bearing slidably attached to said lateral shelf rail, wherein a bottom surface of said movable work surface is attached to said lateral bearing.

2. An optical assembly workstation comprising:

a principal work surface;

a movable work surface comprsing an optical work piece arranged above said principal work surface and movable along at least one axial direction relative to said principal work surface; and a frame assembly supporting said movable work surface above said principal work surface and providing a mechanism for moving said work surface relative to said principal work surface, said principal work surface containing an opening through which said frame assembly upwardly extends, said frame assembly further comprising:

a vertical support member extending upwardly through said opening in said principal work surface, a lateral support member connected at one end to an upper end of said vertical support member;

a lateral shelf rail attached to an upper surface of said lateral support member; and a lateral bearing slidably attached to said lateral shelf rail, wherein a bottom surface of said movable work surface is attached to said lateral bearing.

3. The optical assembly workstation of claim 2, further comprising a vise attached to said bearing for gripping a side of said optical work piece.

4. An optical assembly workstation comprising:

a principal work surface;

a movable work surface comprsing an optical work piece arranged above said principal work surface and movable along at least one axial direction relative to said principal work surface; and a frame assembly supporting said movable work surface above said principal work surface and providing a mechanism for moving said work surface relative to said principal work surface, said principal work surface containing an opening through which said frame assembly upwardly extends, said frame assembly further comprising:

a vertical support member extending upwardly through said opening in said principal work surface;

a lateral support member connected at one end to an upper end of said vertical support member;

a lateral shelf rail attached to an upper surface of said lateral support member;

a lateral bearing slidably attached to said lateral shelf rail;

a logitudinal shelf rail attached to said lateral bearing; and a longitudinal bearing slidably attached to said longitudinal shelf rail, wherein a bottom surface of said movable work surface is attached to said longitudinal bearing.

5. An optical assembly workstation comprising:

a principal work surface;

a movable work surface comprsing an optical work piece arranged above said principal work surface and movable along at least one axial direction relative to said principal work surface; and a frame assembly supporting said movable work surface above said principal work surface and providing a mechanism for moving said work surface relative to said principal work surface said frame assembly further comprising:

a lateral frame rail arranged below said principal work surface, wherein a lower end of a vertical support member of said frame assembly is slidably attached to said lateral frame rail, and wherein said principal work surface contains an elongated lateral opening through which an upper end of said vertical support member upwardly extends.

6. The optical assembly workstation of claim 5, said frame assembly comprising a lateral shelf rail connected at one end to said upper end of said vertical support member, and a lateral bearing slidably attached to said lateral shelf rail, wherein a bottom surface of said movable work surface is attached to said lateral bearing.

7. The optical assembly workstation of claim 5, said frame assembly comprising a lateral support member connected at one end to said upper end of said vertical support member, a lateral shelf rail attached to an upper surface of said lateral support member, and a lateral bearing slidably attached to said lateral shelf rail, wherein a bottom surface of said movable work surface is attached to said lateral bearing.

8. The optical assembly workstation of claim 5, wherein said movable work surface is movable in lateral and longitudinal directions relative to said principal work surface, and said frame assembly comprises a lateral shelf rail connected at one end to said upper end of said vertical support member, a lateral bearing slidably attached to said lateral shelf rail, a longitudinal shelf rail attached to said lateral bearing, and a longitudinal bearing slidably attached to said longitudinal shelf rail, wherein a bottom surface of said movable work surface is attached to said longitudinal bearing.

9. The optical assembly workstation of claim 8, further comprising a longitudinal frame rail arranged below said principal work surface, wherein said lower end of said frame assembly is slidably attached to said longitudinal frame rail, and wherein said principal work surface contains an elongated longitudinal opening through which said upper end of said vertical support member upwardly extends.

10. The optical assembly workstation of claim 8, wherein said lateral shelf rail and said longitudinal shelf rail are perpendicularly arranged.

11. The optical assembly workstation of claim 5, wherein said movable work surface is movable in lateral and longitudinal directions relative to said principal work surface, and said frame assembly comprises a lateral support member connected at one end to said upper end of said vertical support member, a lateral shelf rail attached to an upper surface of said lateral support member, a lateral bearing slidably attached to said lateral shelf rail, a longitudinal shelf rail attached to said lateral bearing, and a longitudinal bearing slidably attached to said longitudinal shelf rail, wherein a bottom surface of said movable work surface is attached to said longitudinal bearing.

12. The optical assembly workstation of claim 11, further comprising a longitudinal frame rail arranged below said principal work surface, wherein said lower end of said frame assembly is slidably attached to said longitudinal frame rail, and wherein said principal work surface contains an elongated longitudinal opening through which said upper end of said vertical support member upwardly extends.

* * * * *